US011322076B2

(12) United States Patent
Shi et al.

(10) Patent No.: US 11,322,076 B2
(45) Date of Patent: May 3, 2022

(54) PIXEL DRIVING CHIP AND DRIVING METHOD THEREFOR, AND DISPLAY APPARATUS

(71) Applicants: BOE MLED TECHNOLOGY CO., LTD., Beijing (CN); BOE TECHNOLOGY GROUP CO., LTD., Beijing (CN)

(72) Inventors: Lingyun Shi, Beijing (CN); Wenchieh Huang, Beijing (CN); Ming Chen, Beijing (CN); Xue Dong, Beijing (CN); Haiwei Sun, Beijing (CN); Xiurong Wang, Beijing (CN); Qibing Gu, Beijing (CN); Guofeng Hu, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/418,585

(22) PCT Filed: Oct. 21, 2020

(86) PCT No.: PCT/CN2020/122316
§ 371 (c)(1),
(2) Date: Jun. 25, 2021

(87) PCT Pub. No.: WO2021/082994
PCT Pub. Date: May 6, 2021

(65) Prior Publication Data

US 2022/0084460 A1 Mar. 17, 2022

(30) Foreign Application Priority Data

Nov. 1, 2019 (CN) ..... 201911059962.3

(51) Int. Cl.
*G09G 3/32* (2016.01)

(52) U.S. Cl.
CPC ..... *G09G 3/32* (2013.01); *G09G 2310/027* (2013.01); *G09G 2310/0267* (2013.01); *G09G 2310/08* (2013.01); *G09G 2330/04* (2013.01)

(58) Field of Classification Search
CPC ..... G09G 3/32; G09G 2310/0267; G09G 2310/027; G09G 2310/08; G09G 2330/04
See application file for complete search history.

(56) References Cited

U.S. PATENT DOCUMENTS

2005/0265709 A1 12/2005 Kim et al.
2006/0290622 A1 12/2006 Nakatogawa
(Continued)

FOREIGN PATENT DOCUMENTS

CN 103390390 A 11/2013
CN 105448233 A 3/2016
(Continued)

OTHER PUBLICATIONS

First office action issued in Chinese Patent Application No. 201911059962.3 with search repor.

*Primary Examiner* — Andrew Sasinowski
(74) *Attorney, Agent, or Firm* — Chiwin Law LLC

(57) ABSTRACT

A pixel driving chip and a driving method therefor, and a display apparatus. The pixel driving chip includes a data input circuit, a time selection circuit, and a current control circuit; the data input circuit is configured to receive display data, and partition the display data to obtain a data partition to which the display data belongs in M data partitions that are obtained on the basis of a display data range; the time selection circuit is configured to determine, according to the data partition to which the display data belongs, an output time length corresponding to the display data, and within the output time length, output the display data to the current
(Continued)

control circuit; the current control circuit is configured to determine, according to the display data, a driving current flowing through a light emitting element corresponding to the display data.

19 Claims, 5 Drawing Sheets

(56) References Cited

U.S. PATENT DOCUMENTS

| | | | | |
|---|---|---|---|---|
| 2010/0302266 | A1* | 12/2010 | Morita | G09G 3/3688 345/559 |
| 2012/0179923 | A1* | 7/2012 | Sasaki | G09G 3/3659 713/300 |
| 2013/0307838 | A1* | 11/2013 | Kim | G09G 3/3688 345/212 |
| 2018/0268761 | A1* | 9/2018 | Kuo | G09G 3/3275 |
| 2020/0260056 | A1* | 8/2020 | Miura | H04N 9/3164 |
| 2021/0174740 | A1* | 6/2021 | Qian | G09G 3/3233 |

FOREIGN PATENT DOCUMENTS

| | | | |
|---|---|---|---|
| CN | 105989792 | A | 10/2016 |
| CN | 106652920 | A | 5/2017 |
| CN | 107767811 | A | 3/2018 |
| CN | 107909967 | A | 4/2018 |
| CN | 108172170 | A | 6/2018 |
| CN | 109859682 | A | 6/2019 |
| CN | 110010057 | A | 7/2019 |
| CN | 110021264 | A | 7/2019 |
| CN | 110021265 | A | 7/2019 |

* cited by examiner

PIXEL DRIVING CHIP AND DRIVING METHOD THEREFOR, AND DISPLAY APPARATUS

CROSS REFERENCE TO RELATED APPLICATIONS

This application is a U.S. National Phase Entry of International Application No. PCT/CN2020/122316 filed on Oct. 21, 2020, designating the United States of America and claiming priority to Chinese Patent Application No. 201911059962.3, filed on Nov. 1, 2019. The present application claims priority to and the benefit of the above-identified applications and the above-identified applications are incorporated by reference herein in their entirety.

TECHNICAL FIELD

Embodiment of the present disclosure relate to a pixel driving chip and a driving method thereof, and a display device.

BACKGROUND

Light-Emitting Diode (LED) display device is one of the hot spots in the research field at present. Compared with a Liquid Crystal Display (LCD), the LED display device has advantages of low energy consumption, low production cost and self-illumination, etc.

The driving mode of a driving circuit of the LED display device is different from that of the driving mode of a driving circuit of the LCD. The driving circuit of the LED display device adopts a current driving mode, while the driving circuit of LCD adopts a voltage driving mode. Compared with the voltage driving mode, the current driving mode is more susceptible to a turn-on voltage of transistor, carrier mobility and circuit voltage drop.

SUMMARY

At least one embodiment of the present disclosure provides a pixel driving chip, comprising: a data input circuit, a time selection circuit, and a current control circuit; the data input circuit is connected to the time selection circuit, and is configured to receive display data and partition the display data according to a gray scale demarcation point to obtain a data partition, to which the display data belongs, among M data partitions obtained based on a range of the display data, and the M data partitions respectively correspond to M output durations; the time selection circuit is connected to the data input circuit and the current control circuit, and is configured to determine an output duration corresponding to the display data according to the data partition to which the display data belongs, and output the display data to the current control circuit within the output duration; and the current control circuit is connected to the time selection circuit, and is configured to determine a driving current flowing through a light-emitting element, corresponding to the display data, according to the display data and output the driving current based on the output duration corresponding to the display data, where M is an integer greater than 1.

For example, in the pixel driving chip provided by at least one embodiment of the present disclosure, the driving current flowing through the light-emitting element, the output duration and brightness corresponding to the display data satisfy a following formula:

$$B=\int K*I*T,$$

where B represents the brightness corresponding to the display data, I represents the driving current flowing through the light-emitting element, T represents the output duration, and K represents a scale factor.

For example, in the pixel driving chip provided by at least one embodiment of the present disclosure, minimum display data of an (m+1)-th data partition is greater than maximum display data of an (m)-th data partition, and an (m+1)-th output duration corresponding to the (m+1)-th data partition is greater than an (m)-th output duration corresponding to the (m)-th data partition, where m is an integer greater than or equal to 1 and less than M.

For example, in the pixel driving chip provided by at least one embodiment of the present disclosure, output durations respectively corresponding to respective data partitions are obtained by rendering driving currents respectively corresponding to maximum display data in the respective data partitions to be same.

For example, in the pixel driving chip provided by at least one embodiment of the present disclosure, the pixel driving chip is configured to obtain a corresponding relationship of display data and a driving current of at least one of the data partitions; and the pixel driving chip further comprises a gray scale conversion circuit, the gray scale conversion circuit is connected to the data input circuit, and is configured to, upon receiving display data belonging to other data partitions except for the at least one of the data partitions, convert the display data belonging to the other data partitions into display data in the at least one data partition according to a proportional relationship between output durations corresponding to the other data partitions and an output duration corresponding to the at least one of the data partitions, so as to obtain driving currents corresponding to the display data belonging to the other data partitions according to the corresponding relationship between the display data and the driving current of the at least one data partition.

For example, the pixel driving chip provided by at least one embodiment of the present disclosure, further comprises a gray scale holding circuit, the gray scale holding circuit is connected to the gray scale conversion circuit and the time selection circuit, and is configured to hold the display data belonging to the other data partitions in the display data that is converted, and output the display data that is converted to the time selection circuit when an output duration corresponding to the display data that is converted comes.

For example, in the pixel driving chip provided by at least one embodiment of the present disclosure, the time selection circuit comprises M time selection sub-circuits, and the current control circuit comprises M current control sub-circuits, the M time selection sub-circuits are in one-to-one correspondence with the M data partitions, the M time selection sub-circuits are connected to the data input circuit and are in one-to-one correspondence with and connected to the M current control sub-circuits, and the M time selection sub-circuits are configured to select a time selection sub-circuit and a current control sub-circuit that are corresponding to the data partition to which the display data received by the data input circuit belongs, so that the time selection sub-circuit, which is selected, outputs the display data to a current control sub-circuit connected to the selected time selection sub-circuit within the output duration corresponding to the display data, and the current control sub-circuit outputs the driving current within the output duration corresponding to the display data.

For example, the pixel driving chip provided by at least one embodiment of the present disclosure, further comprises a voltage conversion circuit, the voltage conversion circuit is connected to a power supply, the data input circuit and the current control circuit, and is configured to convert a power supply voltage provided by the power supply into a voltage required by the data input circuit and the current control circuit.

For example, the pixel driving chip provided by at least one embodiment of the present disclosure, further comprises a timing control circuit; the timing control circuit is connected to the power supply, the time selection circuit and the current control circuit, and is configured to provide a clock signal for controlling the output duration corresponding to the display data.

For example, in the pixel driving chip provided by at least one embodiment of the present disclosure, the time selection circuit is configured to output the display data to the current control circuit within the output duration in response to the clock signal.

For example, the pixel driving chip provided by at least one embodiment of the present disclosure further comprises at least one electrostatic discharge circuit; the at least one electrostatic discharge circuit is respectively connected to at least one selected from a group consisting of the power supply, the data input circuit, the current control circuit and a ground terminal, and is configured to discharge static electricity generated by the at least one selected from the group consisting of the power supply, the data input circuit, the current control circuit and the ground terminal in a case where the at least one selected from the group consisting of the power supply, the data input circuit receives signals or outputs signals.

At least one embodiment of the present disclosure also provides a display device including the pixel driving chip provided by any embodiment of the present disclosure and the light-emitting element, the pixel driving chip is electrically connected to the light-emitting element to output the driving current flowing through the light-emitting element.

For example, the display device provided by at least one embodiment of the present disclosure, further comprises a gate driving circuit and a data driving circuit; the gate driving circuit is configured to provide a scanning signal to the pixel driving chip; and the data driving circuit is configured to provide the display data to the pixel driving chip.

For example, the display device provided by at least one embodiment of the present disclosure, further comprises a display panel and a backlight unit, the backlight unit comprises a plurality of backlight partitions and is driven by a local dimming mode, and at least one of the plurality of backlight partitions comprises the pixel driving chip and the light-emitting element.

At least one embodiment of the present disclosure provides a driving method of a pixel driving chip, comprising: receiving the display data by the data input circuit, and partitioning the display data according to the gray scale demarcation point, to obtain the data partition, to which the display data belongs, among the M data partitions obtained based on the range of the display data, wherein the M data partitions respectively correspond to the M output durations; determining, by the time selection circuit, the output duration corresponding to the display data according to the data partition to which the display data belongs, and outputting the display data to the current control circuit within the output duration; and determining, by the current control circuit, the driving current flowing through the light-emitting element, corresponding to the display data, according to the display data, and outputting the driving current based on the output duration corresponding to the display data.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1A:
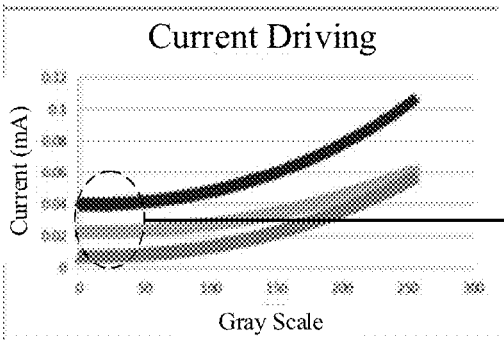
FIG. 1A is a schematic diagram of a display panel adopting a current control method.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment (s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "left," "right" and the like are only used to indicate relative position relationship, and when the position of the object which is described is changed, the relative position relationship may be changed accordingly.

In the field of display technology, the sub-pixels per inch of a display panel can be improved by reducing a space between light-emitting elements included in each sub-pixel, thereby improving the display resolution of the display panel. After improving the display resolution of the display panel, multiplexing architecture and time-sharing driving method are usually adopted to reduce the number of driving traces to reduce the display cost. However, although the time-sharing driving method can reduce driving traces, it is easy to cause problems such as increased current flowing through light-emitting elements, high power consumption of the display panel, high display flicker and so on, thus reducing the display effect of the display panel.

Based on a display device in which the light-emitting element is current-driven, such as an OLED (Organic Light-Emitting Diode), Micro-led or mini-led, at present, the current control method or time control method (i.e., time division method) is usually used to adjust the brightness or gray scale of the light-emitting diode, the adjustment factor is current or time, and the transfer function is:

$$B=\int K*I, \text{ or, } B=\int K*T; \quad (1)$$

where B represents brightness of the light-emitting element (e.g., corresponding to the gray scale), K represents a scale factor, I represents a driving current flowing through the light-emitting element, and T represents a display duration of the light-emitting element (or the output duration of the driving current).

Figure 1B:
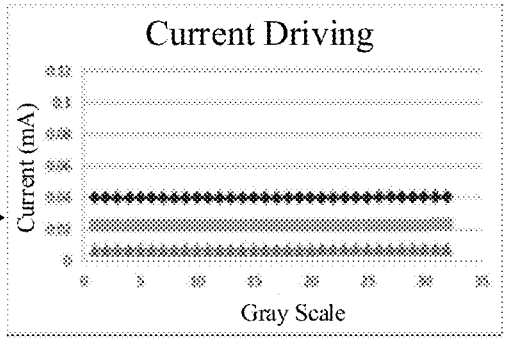
FIG. 1B is a schematic diagram of current driving of the display panel shown in FIG. 1A in the case where a low gray scale is displayed.

However, in the case where the current control method is used to drive the display panel, because of the light-emitting characteristics of the light-emitting elements, a very small current is needed to drive to realize low gray-scale display. FIG. 1A is a schematic diagram of a display panel adopting a current control method. For example, as shown in FIG. 1A, the driving current of the display panel, in the case where a low gray scale is displayed, is indicated in the ellipse formed by a dotted line. FIG. 1B is a schematic diagram of current driving of the display panel shown in FIG. 1A in the case where a low gray scale is displayed, that is, FIG. 1B is a schematic diagram after enlarging the elliptical part formed by the dotted line shown in FIG. 1A. As shown in FIG. 1B, in the case where the display panel displays a low gray scale, the maximum driving current is about 0.04 milliamp (mA), and the current changes smoothly. Therefore, the current control method will have some problems, such as a problem that the current gradient is too small to control accurately, and a problem of wavelength shift, which can increase the complexity of the structure of the pixel driving chip and the difficulty of the preparation process.

In addition, the time control method requires the pixel driving chip to have a high-frequency oscillator (abbreviated as OSC), or has higher requirements on the accuracy of the received clock signal provided by the display panel, thus increasing the complexity of the structure, size, power consumption of the pixel driving chip and high-frequency wiring of the display panel, and having higher requirements on the process specifications of a display substrate.

At least one embodiment of the present disclosure provides a pixel driving chip, the pixel driving chip comprises: a data input circuit, a time selection circuit and a current control circuit; the data input circuit is connected to the time selection circuit, and is configured to receive display data and partition the display data according to a gray scale demarcation point to obtain a data partition, to which the display data belongs, among M data partitions obtained based on a range of the display data, and the M data partitions respectively correspond to M output durations; the time selection circuit is connected to the data input circuit and the current control circuit, and is configured to determine an output duration corresponding to the display data according to the data partition to which the display data belongs, and output the display data to the current control circuit within the output duration; the current control circuit is connected to the time selection circuit, and is configured to determine a driving current flowing through a light-emitting element, corresponding to the display data, according to the display data and output the driving current based on the output duration corresponding to the display data, where M is an integer greater than 1.

Some embodiments of the present disclosure further provide a display device and a driving method that correspond to the above mentioned pixel driving chip.

The pixel driving chip provided by the above embodiments of the present disclosure, the driving current of the display panel in the case where a high gray scale is displayed can be reduced and the driving current of the display panel in the case where a low gray scale is displayed can be improved by adopting a gray scale segmented driving mode; and the pixel driving chip has a simple structure, can reduce the flicker degree of the display panel, improve the driving efficiency of the display panel, reduce the power consumption and implementation cost of the display panel, and is beneficial to improving the display effect of the display panel.

Embodiments of the present disclosure and examples thereof are described in detail with reference to the accompanying drawings as follows.

Figure 2:
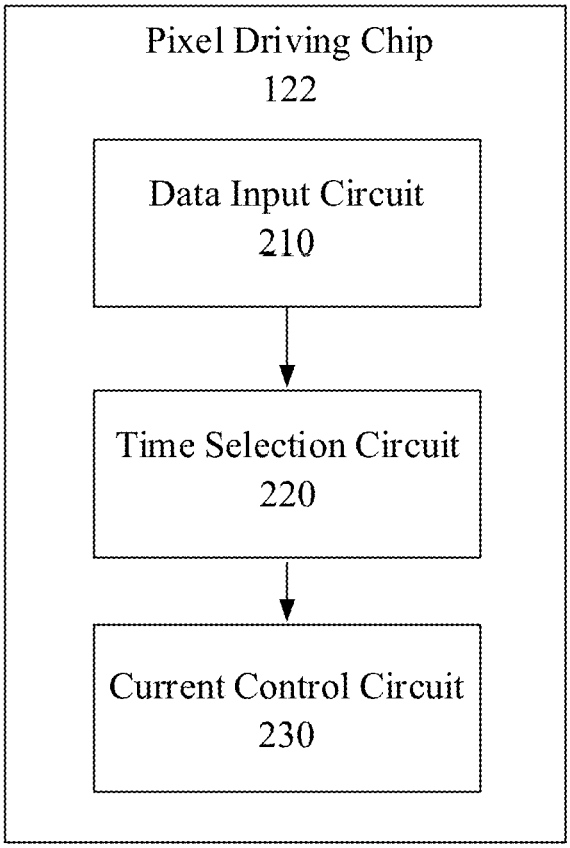
FIG. 2 is a schematic diagram of a pixel driving chip provided by at least one embodiment of the present disclosure.
Figure 3A:
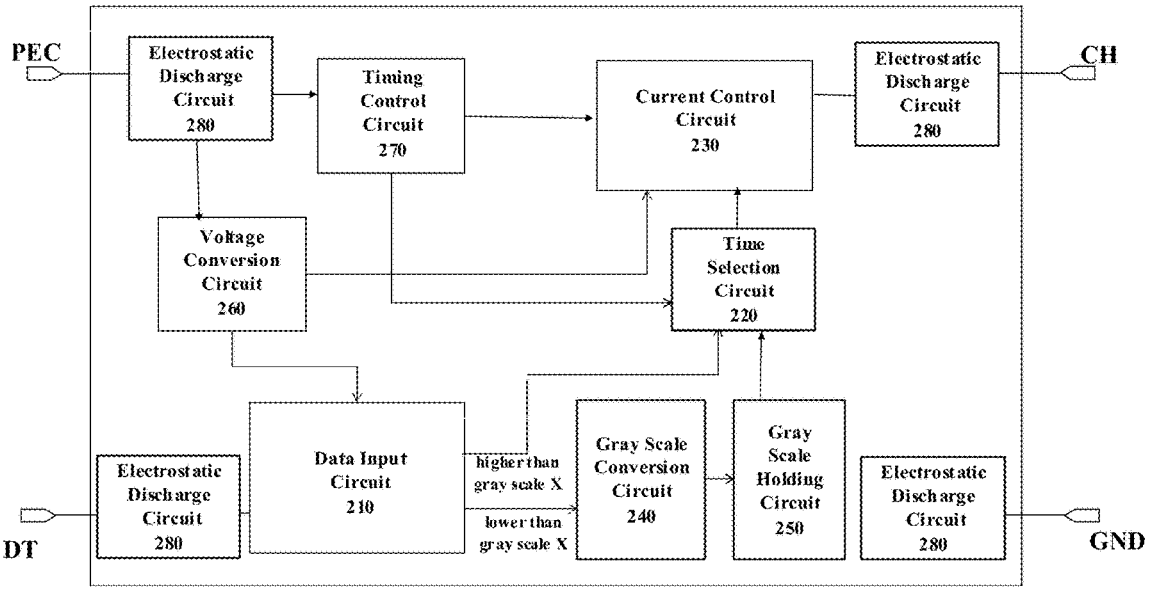
FIG. 3A is a schematic diagram of another pixel driving chip provided by at least one embodiment of the present disclosure.
Figures 4A, 4B:
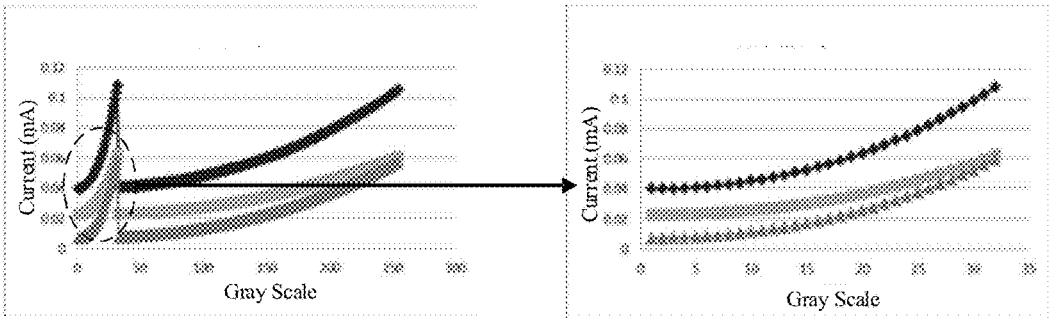
FIG. 4A is a schematic diagram of a driving current provided by at least one embodiment of the present disclosure.
FIG. 4B is a schematic diagram of current driving of the display panel shown in FIG. 4A in the case where a low gray scale is displayed.
Figure 5:
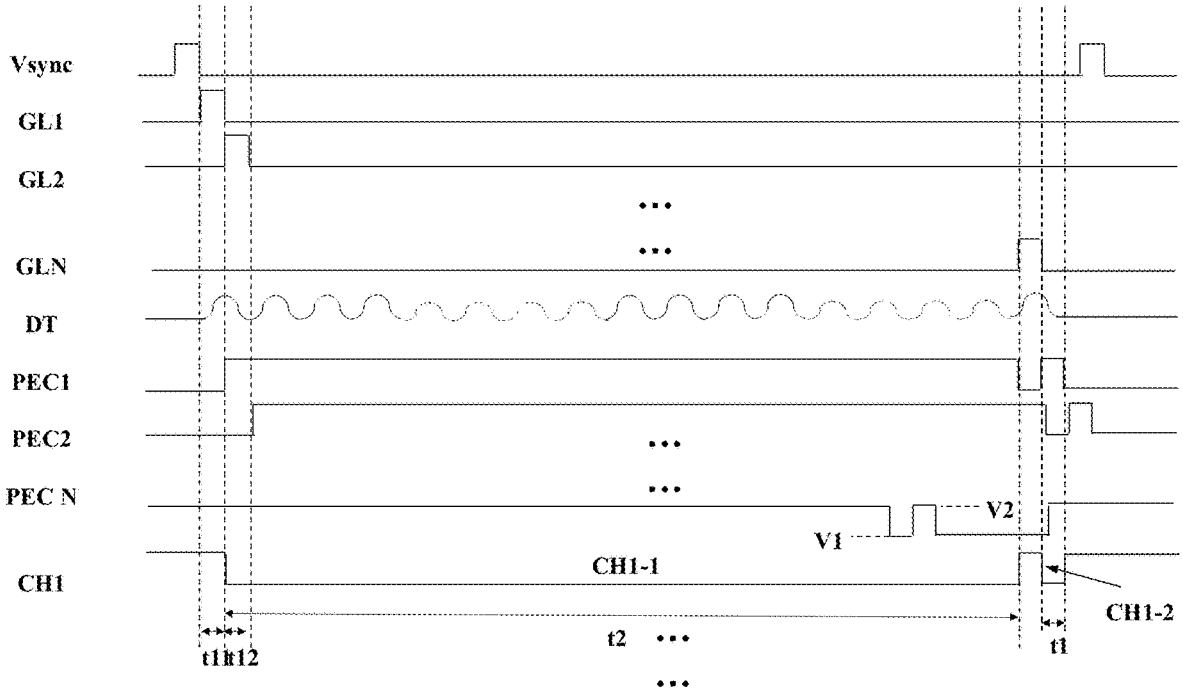
FIG. 5 is an operation timing diagram of a pixel driving chip provided by at least one embodiment of the present disclosure.

FIG. 2 is a schematic diagram of a pixel driving chip provided by at least one embodiment of the present disclosure; FIG. 3A is a schematic diagram of another pixel driving chip provided by at least one embodiment of the present disclosure; FIG. 4A is a schematic diagram of a driving current provided by at least one embodiment of the present disclosure; FIG. 4B is a schematic diagram of current driving of the display panel shown in FIG. 4A in the case where a low gray scale is displayed; FIG. 5 is an operation timing diagram of a pixel driving chip provided by at least one embodiment of the present disclosure; and FIG. 6 is a schematic diagram of a display device provided by at least one embodiment of the present disclosure.

Next, the pixel driving chip provided by at least one embodiment of the present disclosure is described in detail with reference to FIGS. 2 to 6.

Figure 6:
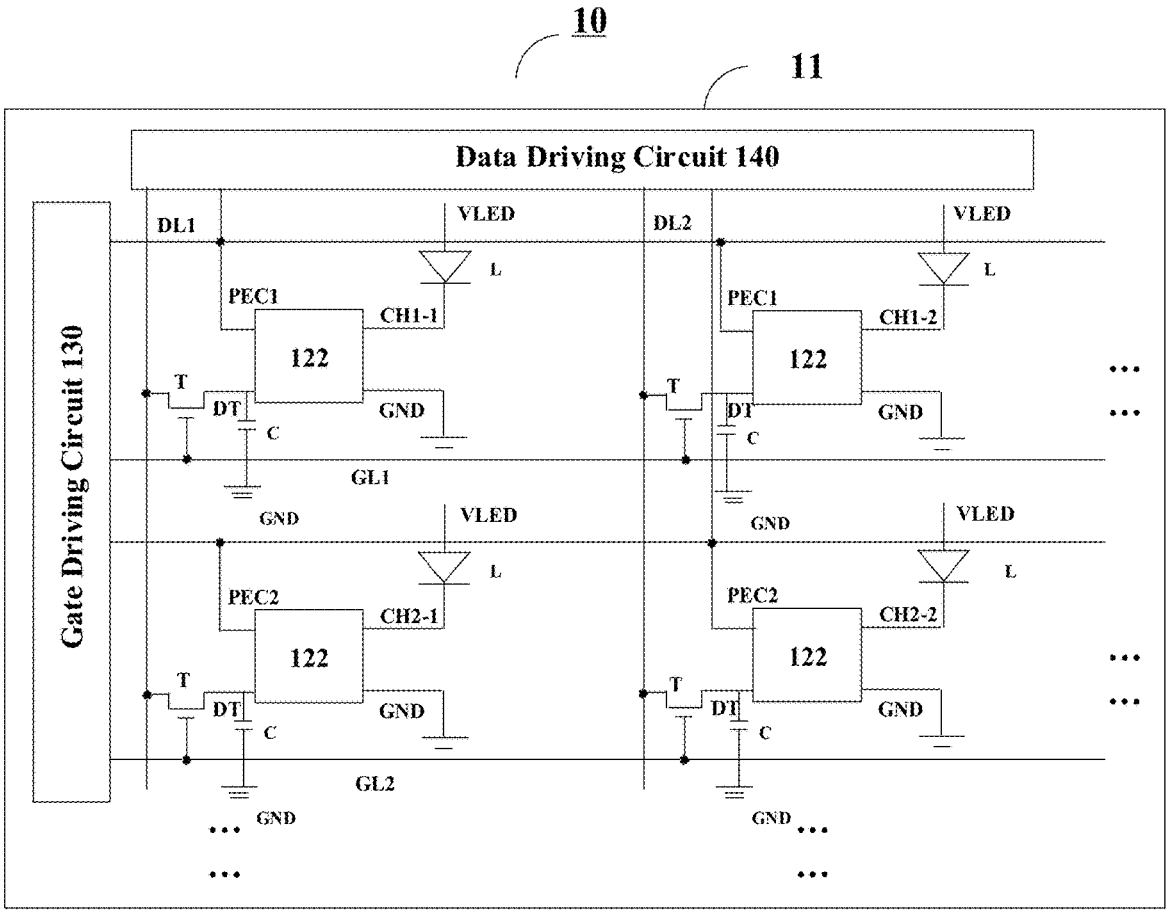
FIG. 6 is a schematic diagram of a display device provided by at least one embodiment of the present disclosure.

As shown in FIG. 6, the display device 10 includes a pixel driving chip 122 and a light-emitting element L provided by any embodiment of the present disclosure. For example, the pixel driving chip 122 is electrically connected to the light-emitting element L to output a driving current flowing through the light-emitting element L. For example, in some examples, the pixel driving chip may be located in a pixel unit of a display panel to drive a light-emitting element connected to the pixel unit to emit light. For example, in some other examples, in the case where the display device includes a display panel 11 and a backlight unit 12, the backlight unit 12 includes a plurality of backlight partitions and is driven by a local dimming mode, and at least one of the plurality of backlight partitions includes the pixel driving chip 122 and the light-emitting element L. For example, in this example, each pixel driving chip is configured to respectively drive the light-emitting element in each backlight partition to emit light. Embodiments of the present disclosure are not limited to this case. The light-emitting element may be OLED (organic light-emitting diode), Micro-led or mini-led.

For example, as shown in FIG. 2, the pixel driving chip 122 includes a data input circuit 210, a time selection circuit 220 and a current control circuit 230.

For example, the data input circuit 210 may be a digital input circuit, or a communication circuit transmitting digital data by a single line.

For example, the data input circuit 210 is connected to the time selection circuit 220, and is configured to receive display data and partition the display data according to a gray scale demarcation point to obtain the data partition, to which the display data belongs, among M data partitions (M is an integer greater than 1, for example, M=2, 3, 4, . . . ) obtained based on a range of the display data. For example, M data partitions respectively correspond to M output durations.

For example, the range of the display data refers to all the display data that a frame of image needs to display, for example, the range of the display data includes display data with gray scale values of 0~P (P is an integer greater than 1). For example, in the case where 256 pieces of display data are included, P=255; in the case where 1024 pieces of display data are included, P=1023, and the value of P may be determined according to specific conditions, the embodiment of the present disclosure is not limited in this aspect.

For example, in the case where M data partitions are included, M−1 gray scale demarcation points may be included, so that P+1 display data are divided into the following M data partitions: a first data partition 0-p1, a second data partition p1-p2, . . . , an (m)-th data partition p (m−1)~−p (m), . . . , and the (M)-th data partition p (M−1)~p(M). For example, m is an integer greater than or equal to 1 and less than M.

For example, minimum display data of an (m+1)-th data partition is greater than maximum display data of an (m)-th data partition, and an (m+1)-th output duration corresponding to the (m+1)-th data partition is greater than an (m)-th output duration corresponding to the (m)-th data partition. That is, the display data of a high gray scale corresponds to a larger output duration, and the display data of a low gray scale corresponds to a smaller output duration. For example, in the embodiment of the present disclosure, the output duration corresponding to the display data of high gray scale is equal to a larger display duration of the light-emitting element in one frame of display duration t, and the output duration corresponding to the display data of low gray scale is equal to a smaller display duration of the light-emitting element in one frame of display duration t.

For example, taking two data partitions as an example, the following embodiments are the same and will not be described again. For example, the M data partitions obtained based on the range of the display data include two data partitions, i.e., M=2, and the output durations corresponding to the two data partitions also include two output durations, namely an output duration t1 and an output duration t2. For example, t2=t−t1. For example, t2 takes up most of the display duration t of one frame, and t1 takes up a smaller part of the display duration t of one frame, so that it is possible to realize the segmented driving of gray scale. For example, as shown in FIG. 4A, the first data partition is a data partition including low gray scales, for example, 0-32 gray scales, and the second data partition is a data partition including high gray scales, for example, 33~255 gray scales, for example, in this example, the gray scale demarcation point X is equal to 32. Of course, the setting of the gray scale demarcation point may depend on the specific situation, and the embodiment of the present disclosure is not limited in this aspect.

For example, the driving current flowing through the light-emitting element, the output duration and the brightness corresponding to the display data satisfy the following formula:

$$B=\int K*I*T \tag{2}$$

where B represents the brightness corresponding to the display data, and I represents the driving current flowing through the light-emitting element; T represents the output duration, and K represents a scale factor.

For example, the light-emitting element is a light-emitting element suitable for current driving.

Based on the above formula (2), it can be seen that the final display brightness is realized by integrating the output duration and the driving current. For example, for the same display brightness, the driving current flowing through the light-emitting element is higher in the case where the output duration is shorter, and the driving current flowing through the light-emitting element is lower in the case where the output duration is longer.

In the multiplexing scheme, in the case where the display data of the same gray scale is displayed, the output durations of the respective gray scales are only equal to the display duration t of one frame/the number of channels, not the display duration t of the whole frame. Comparatively speaking, the output duration t2 of the display data of a high gray scale provided by the embodiment of the present disclosure corresponds to the output duration t2, which takes up most of the display duration t of one frame. Therefore, the output duration corresponding to the display data of a high gray scale in the embodiment of the present disclosure is larger than the output duration corresponding to the display data of a high gray scale in the above multiplexing scheme. Based on the above formula (2), it can be seen that in the embodiment of the present disclosure, because the output duration T is larger than that in the above multiplexing scheme, it is possible to reduce the driving current in the case where the display panel displays a high gray scale. In the same way, because the output duration corresponding to the display data of a low gray scale in the embodiment of the present disclosure only accounts for a small part of the display duration t of one frame, the output duration corresponding to the display data of a low gray scale is smaller than the output duration of the display data of a low gray scale (display duration t of one frame/the number of channels) in the above multiplexing scheme. Therefore, compared with the above multiplexing scheme, in the embodiment of the present disclosure, the output duration of the display data of a low gray scale is reduced, and thus it can be seen from the above formula (2), in the case where the output duration T of the display data of a low gray scale is reduced, the driving current of the display panel in the case where a low gray scale is displayed can be increased, so that the problem that the driving current is difficult to control due to the small driving current in the current control method can be overcome.

Therefore, in the embodiment of the present disclosure, by adopting the transfer function as shown in the formula (2), i.e., taking the output duration T and the driving current I as adjustment factors, instead of adopting only the driving current or the output duration as adjustment factors in the formula (1), it is possible to solve the problems such as the problem that the current gradient is too small to be accurately controlled, the problem of the wavelength shift occurs in the current control method, the problem that the pixel driving chip needs to have a high-frequency OSC or the accuracy of receiving the clock signal provided by the display panel is relatively high in a time control method, and so on.

For example, the time selection circuit 220 is connected to the data input circuit 210 and the current control circuit 230, and is configured to determine the output duration corresponding to the display data according to the data partition to which the display data belongs, and output the display data to the current control circuit 230 within the output duration.

For example, the output durations corresponding to the respective data partitions in the pixel driving chip can be preset in the process of preparing the pixel driving chip and stored in a memory of the pixel driving chip. For example, according to the number M of the output durations, gray scale demarcation points that can divide the display data into M data partitions can be set in the pixel driving chip 122, so that the display data received in the process of driving the light-emitting element to emit light can be allocated to the corresponding data partition by comparing the display data with the set gray scale demarcation points, so as to obtain the output duration corresponding to the data partition which the display data belongs to.

For example, in some examples, the output durations corresponding to the respective data partitions are obtained by rendering the driving currents corresponding to the maximum display data in the respective data partitions to be approximately the same.

FIG. 4A is a schematic diagram of a driving current provided by at least one embodiment of the present disclosure; FIG. 4B is a schematic diagram of current driving of the display panel shown in FIG. 4A in the case where a low gray scale is displayed, that is, FIG. 4B is an enlarged schematic view of the elliptical portion formed by the dotted line shown in FIG. 4A.

Referring to FIG. 4A and FIG. 4B, it can be seen that in the case where the display panel displays a low gray scale, the driving current is obviously amplified, which can overcome the problem that the current gradient is too small to be accurately controlled and the problem that the wavelength shift occurs in the current control method.

For example, as shown in FIG. 4A, the driving current corresponding to the maximum display data (e.g., display data of a gray scale 32) of the first data partition (i.e., a data partition with a low gray scale, e.g., with gray scales 0-32) and the driving current corresponding to the maximum display data (e.g., display data of a gray scale 255) of the second data partition (i.e., a data partition with a high gray scale, e.g., with gray scales 33-255) are substantially the same, for example, they are all around 0.1 mA. In this case, the output durations of the respective data partitions can be obtained based on the above formula (2). For example, the output duration T corresponding to the first data partition can be obtained by substituting the brightness and drive current 0.1 mA corresponding to the gray scale 32 into the above formula (2), and the output duration T corresponding to the second data partition can be obtained by substituting the brightness and drive current 0.1 mA corresponding to the gray scale 255 into the above formula (2), for example, the output duration T corresponding to the first data partition satisfies $T=t1=t/1000$, and the output duration T corresponding to the second data partition satisfies $T=t2=t-t/1000=999t/1000$.

For example, the current control circuit 230 is connected to the time selection circuit 220, and is configured to determine the driving current flowing through the light-emitting element, corresponding to the display data, according to the display data, and output the driving current based on the output duration corresponding to the display data.

For example, the light-emitting element displaying different gray scales (i.e., brightness) corresponds to different driving currents, and the current control circuit here is a circuit that generates the driving currents of various gray scales. For example, a look-up table including the correspondence relationship between the display data (e.g., gray scale) and the driving current is pre-stored in the memory of the display panel, and the pixel driving chip can call the look-up table according to the display data which is received by the pixel driving chip and find the driving current corresponding to display data in the look-up table.

For example, the pixel driving chip 122 can obtain the corresponding relationship between display data and driving current of at least one data partition. For example, in the display panel, a look-up table including the correspondence relationship between display data and driving current of at least one data partition is included. In the case where the pixel driving chip 122 receives the display data belonging to the at least one data partition, the driving current corresponding to the received display data can be found in the look-up table. However, for the display data in the data partition where the correspondence relationship between display data and driving current is not stored in the display panel, the corresponding driving current can be obtained by corresponding these display data to the display data in the data partition where the correspondence relationship between display data and driving current has been stored in the display panel.

For example, as shown in FIG. 3A, in this example, the pixel driving chip 122 further includes a gray scale conversion circuit 240. For example, the gray scale conversion circuit 240 is connected to the data input circuit 210, and is configured to, upon receiving display data belonging to other data partitions except for the at least one of the data partitions, convert the display data belonging to the other data partitions into display data in the at least one data partition according to a proportional relationship between output durations corresponding to the other data partitions and an output duration corresponding to the at least one of the data partitions, so as to obtain driving currents corresponding to the display data belonging to the other data partitions according to the corresponding relationship between display data and driving current of the at least one data partition.

For example, as shown in FIG. 3A, it is assumed that the display panel stores the corresponding relationship between display data and driving current in data partitions (e.g., the second data partition) with a gray scale demarcation point X of a gray scale value. Therefore, in the case where the data input circuit 210 receives the display data in these data partitions (e.g., the second data partition), the display data in these data partitions can be directly sent to the time selection circuit 220, so that the output durations corresponding to the display data are determined according to the display data. However, in the case where the data input circuit 210 receives the display data in a data partition (for example, a data partition with a gray scale value smaller than the gray scale demarcation point X (for example, the first data partition)) in which the corresponding relationship between display data and driving current is not stored in the display panel, these display data may be transmitted to the gray scale conversion circuit 240 first. The gray scale conversion circuit 240 can convert display data belonging to the first data partition into display data belonging to the second data partition according to the proportional relationship between the output duration corresponding to the second data partition and the output duration corresponding to the first data partition, that is, the proportional relationship between t2 and t1, so that the driving current belonging to the display data in the first data partition can be obtained from the corresponding relationship between display data and driving current in the second data partition stored in the display panel.

It should be noted that in the case where the corresponding relationship between display data and driving current of a plurality of data partitions is stored, one of the data partitions (for example, an (n)-th data partition (n is an integer greater than or equal to 1 and less than or equal to M)) can be selected to correspond to, by the proportion of the output duration, the display data of an data partition in which the corresponding relationship between display data and driving current is not stored, the specific method is similar to the above description, and is not repeated here.

For example, in this example, as shown in FIG. 3A, the pixel driving chip 122 further includes a gray scale holding circuit 250.

For example, the gray scale holding circuit 250 is connected to the gray scale conversion circuit 240 and the time selection circuit 220, and is configured to hold the display data belonging to the other data partitions in the display data that is converted, and output the display data that is converted to the time selection circuit 220 when an output duration corresponding to the display data that is converted comes.

For example, because the display data can only be transmitted to the time selection circuit 220 in output duration corresponding to the display data, the display data in the first data partition needs to be transmitted to the gray scale holding circuit 250 to be stored after being converted into the display data in the second data partition in the gray scale conversion circuit 240, so that when its corresponding output duration (for example, the output duration t2 corresponding to the second data partition) comes, the gray scale holding circuit 250 outputs the converted display data to the time selection circuit 220, so that the time selection circuit can transmit the display data that is converted to the current control circuit, and the current control circuit can obtain the driving current corresponding to the display data that is converted according to the correspondence relationship between display data and driving current of the second data partition stored in the display panel, thus obtaining the driving current corresponding to the display data in the first data partition, and output the driving current to the light-emitting elements (light-emitting diodes) respectively connected to the channels CH within the output duration t1.

In some examples of the embodiments of the present disclosure, by setting the gray scale conversion circuit, only the correspondence relationship between display data and driving current of display data in a part of data partitions may be stored, and a part of data partitions where the correspondence relationship between display data and driving current is not stored can correspond to the display data in the data partitions where the correspondence relationship between display data and driving current is stored, through a certain proportional relationship (for example, the proportional relationship of output duration), thereby the data partitions where the correspondence relationship between display data and driving current is stored (for example, a data partition of a high gray scale, for example, the second data partition) and the data partitions where the correspondence relationship between display data and driving current is not stored (e.g., a data partition of a low gray scale, e.g., the first data partition) can share the stored correspondence relationship between display data and driving current, thereby reducing the storage capacity of the display panel and reducing requirements for the memory of the display panel.

Of course, in other examples, the display panel may store the corresponding relationship between display data and driving current of all the data partitions, so that the corresponding relationship between display data and driving current of the data partition can be called according to the data partition to which the received display data belongs.

Figure 3B:
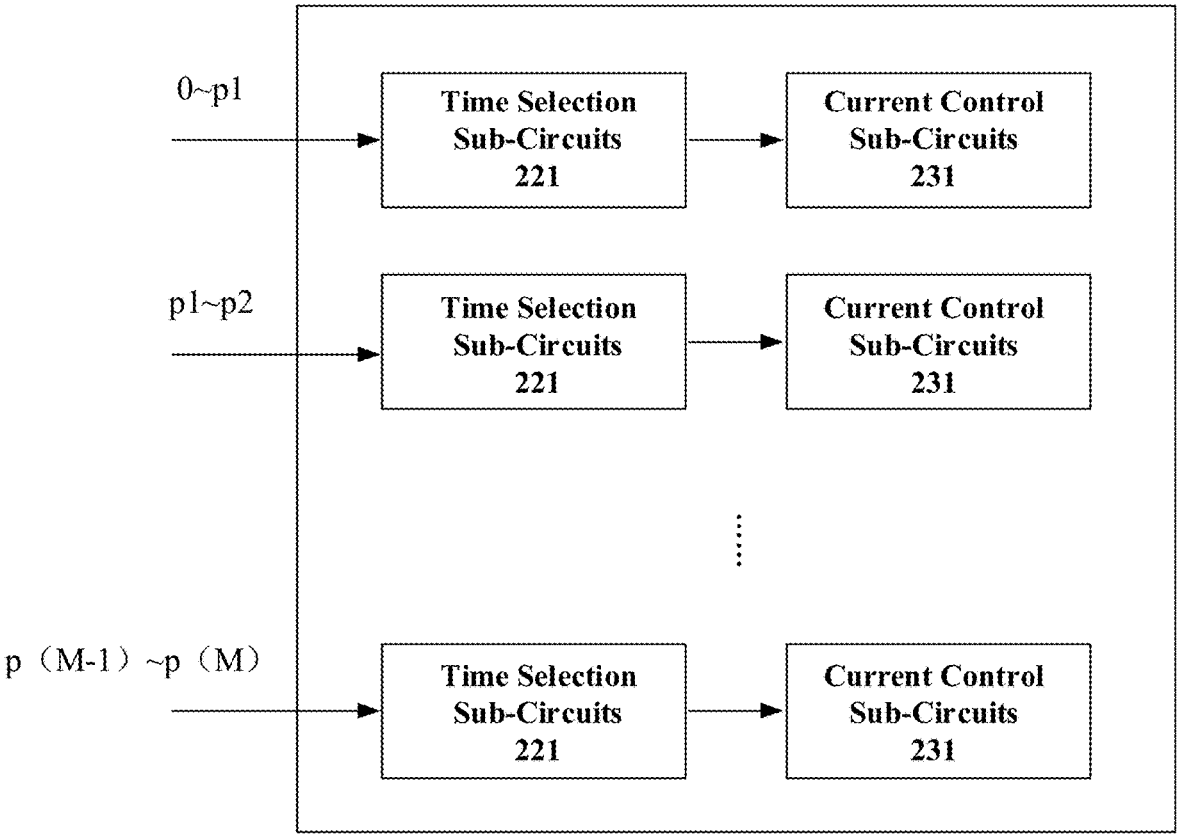
FIG. 3B is a schematic diagram of a time selection circuit and a current control circuit provided by at least one embodiment of the present disclosure.

For example, in this example, as shown in FIG. 3B, the time selection circuit 220 includes M time selection sub-circuits 221, and the current control circuit 230 includes M current control sub-circuits 231.

For example, the M time selection sub-circuits 221 are in one-to-one correspondence with the M data partitions, the M time selection sub-circuits are connected to the data input circuit 221 and are in one-to-one correspondence with and connected to the M current control sub-circuits 231, and the M time selection sub-circuits are configured to select a time selection sub-circuit 221 and a current control sub-circuit 231 that are corresponding to the data partition to which the display data received by the data input circuit belongs, so that the time selection sub-circuit 221, which is selected, outputs the display data to a current control sub-circuit 231 connected to the selected time selection sub-circuit 221 within the output duration corresponding to the display data, and the current control sub-circuit 231 outputs the driving current within the output duration corresponding to the display data.

For example, in this example, because the correspondence relationship between display data and driving current in the first data partition and the correspondence relationship between display data and driving current in the second data partition are both stored in the display panel, the pixel driving chip can find the correspondence relationship between display data and driving current in each data partition from the display panel. Therefore, the pixel driving chip in this example may not include the gray scale conversion circuit and the gray scale holding circuit, and comprises two groups of time selection sub-circuits and current control sub-circuits, so as to respectively receive display data that is in data partitions with a gray scale value greater than the gray scale demarcation point X and display data that is in data partitions with a gray scale value smaller than the gray scale demarcation point X, so as to respectively find and output the driving currents corresponding to the display data in these data partitions.

For example, as shown in FIG. 3A, in other examples, the pixel driving chip 122 further includes a voltage conversion circuit 260.

For example, the voltage conversion circuit 260 is connected to a power supply PEC, the data input circuit 210 and the current control circuit 230, and is configured to convert a power supply voltage provided by the power supply PEC into a voltage required by the data input circuit 210 and the current control circuit 230. For example, power supply voltages required by the circuits are different, and the voltage conversion circuit 260 can convert the voltage provided by the power supply PEC into the power supply voltages required by these circuits to provide power to each circuit in the pixel driving chip 122. For example, the data input circuit 210 may further include a voltage conversion circuit (not shown in the figure) to provide a corresponding voltage to the data input circuit 210 or a circuit connected thereto.

For example, in some examples, the pixel driving chip 122 further includes a timing control circuit 270.

For example, the timing control circuit 270 is connected to the power supply PEC, the time selection circuit 220 and the current control circuit 230, and is configured to provide a clock signal for controlling the output duration corresponding to the display data. For example, in this example, the time selection circuit 220 is configured to output the display data to the current control circuit 230 within the output duration in response to the clock signal.

FIG. 5 is an operation timing diagram of a pixel driving chip provided by at least one embodiment of the present disclosure. For example, in FIG. 5, the case where the range of the display data includes two data partitions and the display device where the pixel driving chip as shown in FIG. 6 is located are taken as an example, the embodiment of the present disclosure is not limited in this aspect. The display device shown in FIG. 6 is described in detail below and is repeated here.

For example, the second data partition (e.g., including a display data of a high grayscale, e.g., gray scale 33-255 shown in FIG. 4A) corresponds to the output duration t2 (e.g., 999t/1000), and the first data partition (e.g., including a display data of a low grayscale, e.g., gray scale 0-32 shown in FIG. 4A) corresponds to the first output duration t1 (e.g., t/1000).

For example, as shown in FIG. 5, the power PEC not only serves as the power supply of the pixel driving chip 122, but also includes a first power bias signal V1 and a second power bias signal V2. For example, the first power supply bias signal V1 is used as the power supply of the pixel driving chip 122, and a change from the first power supply bias signal V1 to the second power supply bias signal V2 is used to control the clock signal. For example, a rising edge when the first power supply bias signal V1 changes to the second power supply bias signal V2 is used as a rising edge of clock signals PEC1~PECN, to control the pixel driving chip 122 to enter the second output duration t2, and enter the first output duration t1 when the next change occurs, the embodiment of the present disclosure is not limited in this aspect. For example, in this case, the time selection circuit 220 outputs the display data of a high gray scale to the current control circuit 230 in response to a clock signal PEC1, and the current control circuit 230 outputs the driving current corresponding to the high gray scale to a channel CH1 connected to the pixel driving chip 122 to drive the light-emitting element connected to the channel CH1 to emit light.

The working principle of the pixel driving chip provided by the embodiment of the present disclosure is described in detail with reference to FIG. 5 and FIG. 6.

For example, as shown in FIG. 5, first, a gate driving circuit outputs gate scanning signals GL1 (output to a first row of switch transistors T as shown in FIG. 6), GL2 (output to a second row of switch transistors T shown in FIG. 6), . . . , GLN (output to an (N)-th row of switch transistors T (not shown in FIG. 6)) line by line in response to a vertical synchronization signal Vsync. For example, the case that the switch transistors T are N-type transistors is taken as an example.

For example, in a first stage t11, a first row of gate scanning signal GL1 is at a high level, and the switch transistors T connected to the first row of gate scanning signal GL1 as shown in FIG. 6 are turned on to write a data signal DL (i.e., the display data) into the first row of pixel driving chips 122, for example, a first data signal DL1 as shown in FIG. 6 is written into the pixel driving chip connected to a channel CH1-1, and a second data signal DL2 is written into the pixel driving chip connected to a channel CH1-2. It should be noted that in the case where more columns of pixel driving chips are included, a plurality of columns of data signals may be written into the pixel driving chips 122 in one-to-one correspondence with the plurality of columns of data signals, the embodiments of the present disclosure is not limited to this aspect.

In the case where the first data signal DL1 is written into the pixel driving chip 122, for example, the data input circuit 210 in FIG. 3A receives the first data signal DL1 and partitions the first data signal DL1 to determine the corresponding output duration of the first data signal DL1 according to the data partition to which first data signal DL1 belongs. For example, assuming that the gray scale of the first data signal DL1 is larger than the gray scale demarcation point X (for example, higher than the gray scale demarcation point 32), that is, the first data signal DL1 belongs to the second data partition, and the output duration corresponding to the first data signal DL1 is the longer second output duration t2 (for example, 999t/1000).

For example, when a rising edge of the clock signal PEC1 is detected, that is, a change of V1-V2 is detected, which means that the second output duration t2 is entered, during which the channel CH1-1 corresponding to the first data signal DL1 is turned on, and the time selection circuit 220 outputs the first data signal DL1 to the current control circuit 230 in response to the rising edge of a first change of V1-V2 of the clock signal PEC1, and the current control circuit 230 finds the driving current corresponding to the first data signal DL1 and outputs this driving current to the channel CH1-1 to drive the light-emitting element L connected to the channel CH1-1 to emit light.

For example, assuming that the gray scale of the second data signal DL2 is also larger than the gray scale demarcation point X (for example, higher than the gray scale demarcation point 32), the output duration corresponding to the second data signal DL2 is also the longer second output duration t2. Therefore, a turn-on duration of the channel CH1-2 is the same as a turn-on duration of the channel CH1-1. The details can refer to the related description about the second output duration t2, and the repletion part is repeated here.

For example, assuming that the gray scale of the second data signal DL2 is smaller than the gray scale demarcation point X (e.g., lower than or equal to the gray scale demarcation point 32), the output duration corresponding to the second data signal DL2 is the shorter first output duration t1 (e.g., t/1000) in the display duration t of one frame.

For example, when the rising edge of the clock signal PEC1 is detected for a second time, that is, when the change of V1-V2 is detected for a second time, which means that the first output duration t1 is entered, during the first output duration t1, the channel CH1-2 corresponding to the second data signal DL2 is turned on, and the time selection circuit 220 outputs the second data signal DL2 to the current control circuit 230 in response to the rising edge of the change of the second V1-V2 of the clock signal PEC1, and the current control circuit 230 finds the driving current corresponding to the second data signal DL2 and outputs this driving current to the channel CH1-2 to drive the light-emitting element 1 connected to the channel CH1-2 to emit light.

It should be noted that the first output duration t1 may be entered when the rising edge of the clock signal PEC1 is detected for the first time, and the second output duration t2 may be entered when the rising edge of the clock signal PEC1 is detected for the second time, as long as the corresponding channel is turned on in the corresponding output duration, which is not limited by the embodiments of the present disclosure. For example, in a second stage t12, the second row of gate scanning signal GL2 is at a high level, and the switch transistors T connected to the second row of gate scanning signal GL2 as shown in FIG. 6 is turned on to write the data signal DL (i.e., the display data) into the second row of pixel driving chips 122, for example, the first data signal DL1 as shown in FIG. 6 is written into the pixel driving chip connected to the channel CH2-1, and the second data signal DL2 is written into the pixel driving chip connected to the channel CH2-2. The specific process can refer to the introduction of the first row of pixel driving chips, and it is not repeated here.

It should be noted that in the case where a third data partition, a fourth data partition, a fifth data partition or more data partitions are included, the working principle of the pixel driving chip is similar to that of the case two data partitions are included as illustrated above, so the repetition part is not repeated here.

For example, the pixel driving chip 122 further includes at least one electrostatic discharge circuit 280. For example, the at least one electrostatic discharge circuit 280 is respectively connected to at least one selected from a group consisting of a power supply PEC, the data input circuit 210, the current control circuit 230 and a ground terminal GND, and is configured to discharge static electricity generated when at least one selected from the group consisting of the power supply PEC, the data input circuit 210, the current control circuit 230 and the ground terminal receives or outputs a signal.

For example, circuits of the pixel driving chip 122 that receive and output signals, that is, all the circuits that exchange signals with the external environment, are connected to electrostatic discharge circuit to discharge static electricity generated by the circuits during signal exchange, thereby protecting the pixel driving chip 122 and prolonging the service life of the pixel driving chip.

Transistors adopted in at least one embodiment of the present disclosure may be thin film transistors, field effect transistors or other switch devices with the same characteristics, and thin film transistors are taken as examples in the embodiments described in the present disclosure. The source electrode and the drain electrode of the transistor here may be symmetrical in structure, so there may be no difference in structure between the source electrode and the drain electrode. In the embodiment of the present disclosure, in order to distinguish the two electrodes of the transistor except the gate electrode, it is described that one of the source electrode and the drain electrode is the first electrode and the other electrode is the second electrode. In addition, transistors can be divided into N-type transistors and P-type transistors according to their characteristics. In the case where the transistor is a P-type transistor, a turn-on voltage is a low-level voltage and a turn-off voltage is a high-level voltage. In the case where the transistor is an N-type transistor, the turn-on voltage is a high level voltage and the turn-off voltage is a low level voltage.

In addition, the transistors in the embodiments of the present disclosure are all explained by taking an N-type transistor as an example. In this case, the first electrode of the transistor is the drain electrode and the second electrode is the source electrode. It should be noted that the present disclosure includes but is not limited to this case. For example, one or more transistors in the selection switches provided by the embodiment of the present disclosure may adopt P-type transistors. In this case, the first electrode of the transistor is the source electrode and the second electrode is the drain electrode. It is only required to connect the electrodes of the selected type of transistors with reference to the electrodes of the corresponding transistors in the embodiment of the present disclosure, and it is required that the corresponding voltage terminals provide the corresponding high voltage or low voltage. In the case where N-type transistors are adopted, Indium Gallium Zinc Oxide (IGZO) may be used as the active layer of the thin film transistors. Compared with the case where Low Temperature Poly Silicon (LTPS) or amorphous silicon (such as hydrogenated amorphous silicon) are used as the active layer of thin film transistors, it can effectively reduce the size of transistors and prevent a leakage current.

The pixel driving chip provided by the above embodiments of the present disclosure may adopt the gray scale segmented driving mode, that is, control the brightness of light-emitting elements with different driving currents with unequal output duration, which can reduce the driving current of the display panel in high gray scale display and improve the driving current of the display panel in low gray scale display. And the pixel driving chip has a simple structure, can reduce the flicker degree of the display panel, improve the driving efficiency of the display panel, reduce the power consumption and implementation cost of the display panel, and is beneficial to improving the display effect of the display panel.

At least one embodiment of the present disclosure further provides a display device. As mentioned above, FIG. 6 is a schematic diagram of the display device provided by at least one embodiment of the present disclosure. As shown in FIG. 6, the display device 10 includes the pixel driving chip 122 provided by any embodiment of the present disclosure and a light-emitting element L, for example, the display device 10 includes the pixel driving chip 122 as shown in FIG. 3A. For example, the pixel driving chip 122 is electrically connected to the light-emitting element L to output the driving current flowing through the light-emitting element L. For example, the display device 10 further includes a display panel 11. The pixel driving chip 122 and the light-emitting element L are provided in pixel units of the display panel 11.

For example, FIG. 6 only schematically shows that one pixel driving chip 122 is connected to one light-emitting element L. In other examples, one pixel driving chip 122 is connected to K light-emitting elements L, K is an integer greater than 1, for example, in some examples, N is an integer multiple of K. Embodiments of the present disclosure are not limited to this case. For example, the light-emitting element may be Mini LED, micro LED or organic LED, and may also be other light emitting diodes, the embodiments of the present disclosure are not limited in this aspect.

For example, the pixel driving chip may be separately fabricated and formed and then mounted on a base substrate (not shown in the figure) by surface mounting technology (SMT), for example, connected to peripheral circuits (such as a gate scanning circuit and a data driving circuit), power supplies or light-emitting elements by leads on pins; or the pixel driving chip may be directly formed on the base substrate to realize corresponding functions. For example, the pixel driving chip may be prepared and cut on a silicon wafer. For example, in at least one embodiment of the present disclosure, both the pixel driving chip and the light-emitting element are separately manufactured and then bound on the base substrate, but of course, they may also be directly manufactured on the base substrate, and the embodiments of the present disclosure are not limited to this case. For example, the base substrate may be a glass substrate, a ceramic substrate, a silicon substrate, and the like.

For example, in some examples, as shown in FIG. 6, the display device 10 further includes a gate driving circuit 130 and a data driving circuit 140 disposed on the base substrate.

For example, the display device 10 includes a switch transistor T, and the switch transistor T is connected to the pixel driving chip 122 and is configured to write a data signal (e.g., an input signal) into the pixel driving chip 122 in response to a scanning signal; the gate driving circuit 130 is electrically connected to the switch transistors T of a plurality of rows of pixel units respectively through a plurality of gate lines GL, and is configured to respectively provide a plurality of scanning signals to the switch transistors T of the plurality of rows of pixel circuits; the data driving circuit 140 is electrically connected to the switch transistors T of a plurality of columns of pixel units through a plurality of data lines DL, and is configured to respectively provide a plurality of data signals to the switch transistors T of the plurality of columns of pixel units.

For example, a gate electrode of the switch transistor T is electrically connected to the gate driving circuit 130 through a connected gate line (e.g., a first switch control line) GL to receive the scanning signal, a first electrode of the switch transistor T is electrically connected to the data driving circuit 140 through a connected data line DL to receive the data signal, and a second electrode of the switch transistor T is connected to the data input circuit 210 of the pixel driving chip 122. For example, the switch transistor T is turned on in response to the scanning signal, and the data signal provided by the data driving circuit 140 is written into the pixel driving chip 122 to be stored so as to drive the light-emitting element to emit light in the display stage.

For example, the display device 10 further includes a capacitor C connected to the switch transistor T. A first electrode of the capacitor C is connected to the second electrode of the switch transistor, and a second electrode of the capacitor C is grounded, so that the data signal transmitted from the switch transistor T to the pixel driving chip 122 can be stored.

For example, the gate driving circuit 130 may be implemented as a gate driving chip (IC) or a gate driving circuit (GOA) directly prepared on an array substrate of the display device. For example, the GOA includes a plurality of cascaded shift register units, which are configured to shift and output scanning signals under control of trigger signals and clock signals provided by peripheral circuits (e.g., a timing controller). The specific cascade mode and working principle can be referred to the design in the art, and are not described in detail here. The data driving circuit 140 may also be referred to the design in the art, and is not described in detail here.

In this example, by integrating the gate driving circuit, the data driving circuit, the pixel driving chip, the light-emitting element L, etc. on the same array substrate, it is possible to store the data signal to the pixel driving chip in an AM (Active-matrix) driving manner. For example, in a display stage, according to actual situations, a second voltage is provided to a second voltage line at the same time or line by line, and then the second voltage is provided to the second electrode of the light-emitting element L, so that the pixel driving chip controls the driving current flowing through the light-emitting element according to the stored data signal to drive the light-emitting element L to emit light according to a certain gray scale (the data signal). That is, in the display stage, the driving of the light-emitting elements still adopts the PM (Passive-Matrix) driving mode. Therefore, in the embodiments of the present disclosure, the driving of the light-emitting elements can be realized by combining the driving modes of AM and PM.

For example, the data driving circuit 140 further provides a clock signal to the pixel driving chip 122. For example, a plurality of rows of pixel driving chips receive a same clock signal, for example, a first row of pixel driving chips 122 receives a first clock signal PEC1, a second row of pixel driving chips 122 receives a second clock signal PEC2, and so on.

For example, in some examples, the display device 10 may be a Mini LED display device or a micro light-emitting diode display device, that is, the pixel driving chip 122 is electrically connected to the light-emitting element L, and is configured to drive the light-emitting element L to emit light of the corresponding gray scale.

Figure 7A:
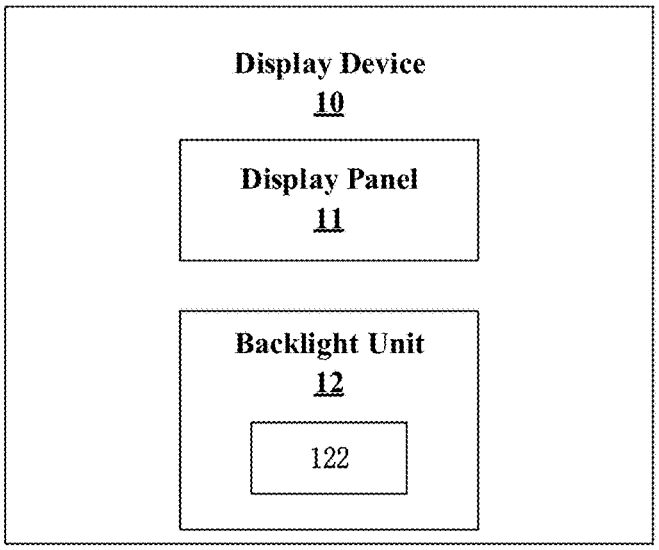
FIG. 7A is a schematic diagram of another display device provided by at least one embodiment of the present disclosure.
Figure 7B:
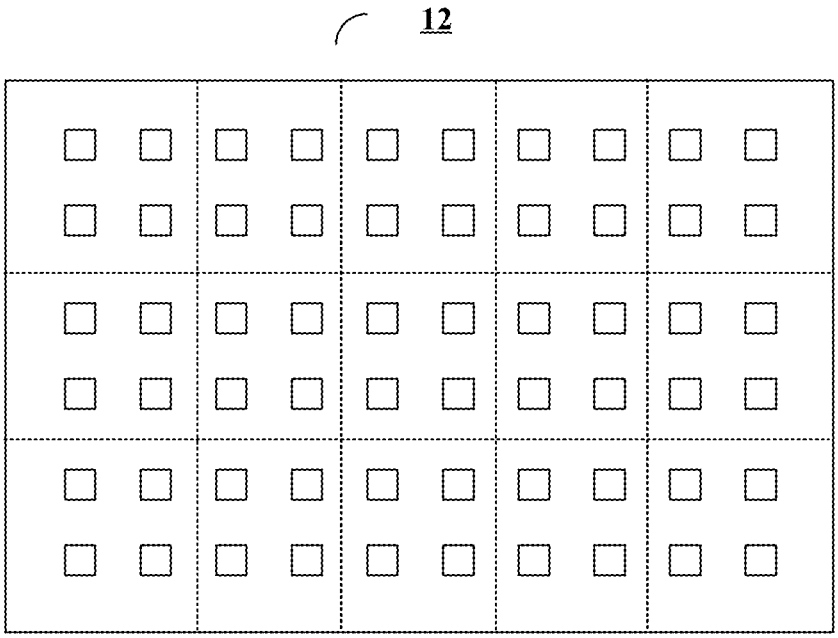
FIG. 7B is a schematic diagram of a backlight partition provided by at least one embodiment of the present disclosure.

For example, in other examples, the display device 10 may be a liquid crystal display device. For example, as shown in FIG. 7A, in this example, the display device 10 further includes a display panel 11 and a backlight unit 12. As shown in FIG. 7B, the backlight unit 12 includes a plurality of backlight partitions (partitions divided by dashed lines in FIG. 7B) and is driven by a local dimming mode, and at least one of the plurality of backlight partitions includes the pixel driving chip 122 and the light-emitting element L. For example, the plurality of backlight partitions may or may not be arranged in an array, embodiments of the present disclosure are not limited to this case. For example, in this example, the pixel driving chips are configured to respectively drive the light-emitting elements in the respective backlight partitions to emit light. Embodiments of the present disclosure are not limited to these cases.

It should be noted that, in order to show clearly and concisely, the embodiments of the present disclosure do not give all the components of the display device 10. In order to realize the basic functions of the display device 10, those skilled in the art can provide and set other structures not shown according to specific needs, and the embodiments of the present disclosure are not limited to this case.

With regard to the technical effects of the display device provided in the above embodiments, reference can be made to the technical effects of the electronic substrate provided in the embodiments of the present disclosure, which is not described in detail here.

Figure 8:
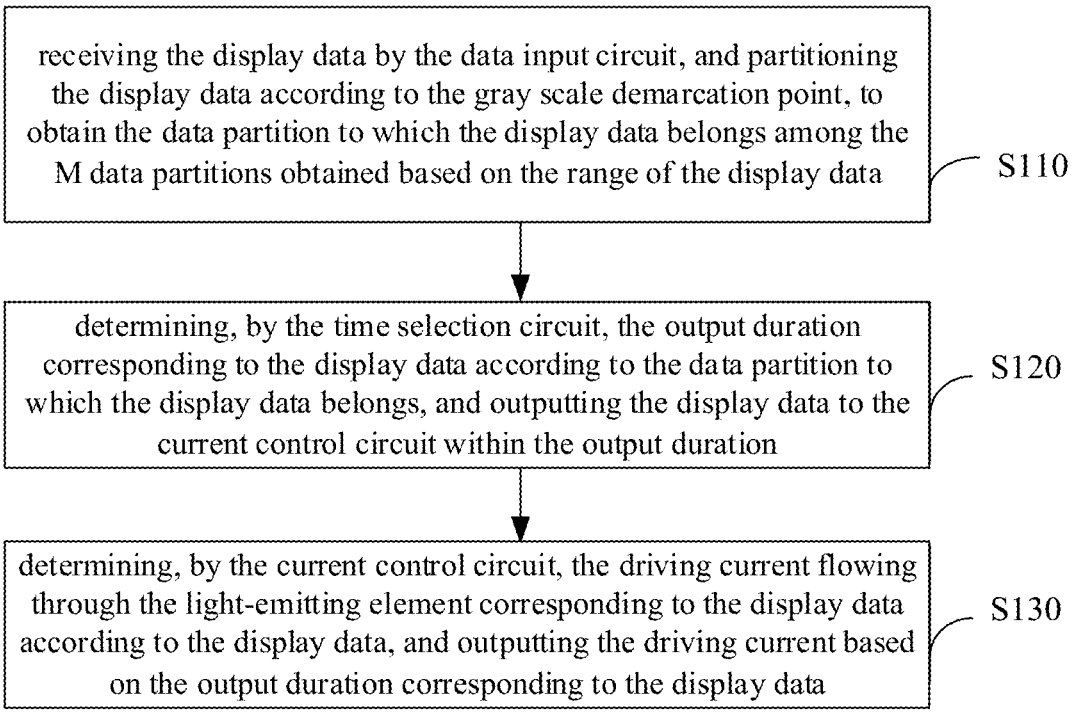
FIG. 8 is a flowchart of a driving method of a pixel driving chip provided by at least one embodiment of the present disclosure.

At least one embodiment of the present disclosure further provides a driving method of the pixel driving chip. FIG. 8 is a flowchart of a driving method of the pixel driving chip provided by at least one embodiment of the present disclosure. As shown in FIG. 8, the driving method of the pixel driving chip includes steps S110-S130.

Step S110: receiving the display data by the data input circuit, and partitioning the display data according to the gray scale demarcation point, to obtain the data partition, to which the display data belongs, among the M data partitions obtained based on the range of the display data.

For example, the M data partitions respectively correspond to the M output durations.

Step S120: determining, by the time selection circuit, the output duration corresponding to the display data according to the data partition to which the display data belongs, and outputting the display data to the current control circuit within the output duration.

Step S130: determining, by the current control circuit, the driving current flowing through the light-emitting element, corresponding to the display data, according to the display data, and outputting the driving current based on the output duration corresponding to the display data.

For example, for the Step S110, for example, the range of the display data refers to all the display data that a frame of image needs to display, for example, the range of the display data includes display data with gray scale values of 0~P (P is an integer greater than 1). For example, in the case where 256 pieces of display data are included, P=255; in the case where 1024 pieces of display data are included, P=1023, and the value of P may be determined according to specific conditions, the embodiment of the present disclosure are not limited in this aspect.

For example, in the case where M data partitions are included, M−1 gray scale demarcation points may be included, so that P+1 display data are divided into the following M data partitions: a first data partition 0-p1, a second data partition p1-p2, . . . , an (m)-th data partition p (m−1)~−p (m), . . . , and the (M)-th data partition p (M−1)~p(M). For example, m is an integer greater than or equal to 1 and less than M.

For example, minimum display data of an (m+1)-th data partition is greater than maximum display data of an (m)-th data partition, and an (m+1)-th output duration corresponding to the (m+1)-th data partition is greater than an (m)-th output duration corresponding to the (m)-th data partition. That is, the display data of a high gray scale corresponds to a larger output duration, and the display data of a low gray scale corresponds to a smaller output duration. For example, in the embodiment of the present disclosure, the output duration corresponding to the display data of high gray scale is equal to a larger display duration of the light-emitting element in one frame of display duration t, and the output duration corresponding to the display data of low gray scale is equal to a smaller display duration of the light-emitting element in one frame of display duration t.

For example, taking two data partitions as an example, the following embodiments are the same and will not be described again. For example, the M data partitions obtained based on the range of the display data include two data partitions, i.e., M=2, and the output durations corresponding to the two data partitions also include two output durations, namely an output duration t1 and an output duration t2. For example, t2=t−t1. For example, t2 takes up most of the display duration t of one frame, and t1 takes up a smaller part of the display duration t of one frame, so that it is possible to realize the segmented driving of gray scale. For example, as shown in FIG. 4A, the first data partition is a data partition including low gray scales, for example, 0-32 gray scales, and the second data partition is a data partition including high gray scales, for example, 33~255 gray scales, for example, in this example, the gray scale demarcation point X is equal to 32. Of course, the setting of the gray scale demarcation point may depend on the specific situation, and the embodiment of the present disclosure is not limited in this aspect.

For example, the driving current flowing through the light-emitting element, the output duration and the brightness corresponding to the display data satisfy the following formula:

$$B=\int K*I*T \quad (2)$$

where B represents the brightness corresponding to the display data, and I represents the driving current flowing through the light-emitting element; T represents the output duration, and K represents a scale factor.

For example, the light-emitting element is a light-emitting element suitable for current driving.

Based on the above formula (2), it can be seen that the final display brightness is realized by integrating the output duration and the driving current. For example, for the same display brightness, the driving current flowing through the light-emitting element is higher in the case where the output duration is shorter, and the driving current flowing through the light-emitting element is lower in the case where the output duration is longer.

For example, for the Step S120, for example, the output durations corresponding to the respective data partitions in the pixel driving chip can be preset in the process of preparing the pixel driving chip and stored in a memory of the pixel driving chip. For example, according to the number M of the output durations, gray scale demarcation points that can divide the display data into M data partitions can be set in the pixel driving chip 122, so that the display data received in the process of driving the light-emitting element to emit light can be allocated to the corresponding data partition by comparing the display data with the set gray scale demarcation points, so as to obtain the output duration corresponding to the data partition which the display data belongs to.

For example, in some examples, the output durations corresponding to the respective data partitions are obtained by rendering the driving currents corresponding to the maximum display data in the respective data partitions to be approximately the same.

FIG. 4A is a schematic diagram of a driving current provided by at least one embodiment of the present disclosure; FIG. 4B is a schematic diagram of current driving of the display panel shown in FIG. 4A in the case where a low gray scale is displayed, that is, FIG. 4B is an enlarged schematic view of the elliptical portion formed by the dotted line shown in FIG. 4A. Referring to FIG. 4A and FIG. 4B, it can be seen that in the case where the display panel displays a low gray scale, the driving current is obviously amplified, which can overcome the problem that the current gradient is too small to be accurately controlled and the problem that the wavelength shift occurs in the current control method.

For example, as shown in FIG. 4A, the driving current corresponding to the maximum display data (e.g., display data of a gray scale 32) of the first data partition (i.e., a data partition with a low gray scale, e.g., with gray scales 0-32) and the driving current corresponding to the maximum display data (e.g., display data of a gray scale 255) of the second data partition (i.e., a data partition with a high gray scale, e.g., with gray scales 33-255) are substantially the same, for example, they are all around 0.1 mA. In this case, the output durations of the respective data partitions can be obtained based on the above formula (2). For example, the output duration T corresponding to the first data partition can be obtained by substituting the brightness and drive current 0.1 mA corresponding to the gray scale 32 into the above formula (2), and the output duration T corresponding to the second data partition can be obtained by substituting the brightness and drive current 0.1 mA corresponding to the gray scale 255 into the above formula (2), for example, the output duration T corresponding to the first data partition satisfies T=t1=t/1000, and the output duration T corresponding to the second data partition satisfies T=t2=t−t/1000=999t/1000.

For example, for the step 130, for example, the light-emitting element displaying different gray scales (i.e., brightness) corresponds to different driving currents, and the current control circuit here is a circuit that generates the driving currents of various gray scales. For example, a look-up table including the correspondence relationship between display data (e.g., gray scale) and driving current is pre-stored in the memory of the display panel, and the pixel driving chip can call the look-up table according to the display data which is received by the pixel driving chip and find the driving current corresponding to display data in the look-up table.

For example, the pixel driving chip 122 can obtain the corresponding relationship between display data and driving current of at least one data partition. For example, in the display panel, a look-up table including the correspondence relationship between display data and driving current of at least one data partition is included. In the case where the pixel driving chip 122 receives the display data belonging to the at least one data partition, the driving current corresponding to the received display data can be found in the look-up table. However, for the display data in the data partition where the correspondence relationship between display data and driving current is not stored in the display panel, the corresponding driving current can be obtained by corresponding these display data to the display data in the data partition where the correspondence relationship between display data and driving current has been stored in the display panel.

For example, as shown in FIG. 3A, in this example, the pixel driving chip 122 further includes a gray scale conversion circuit 240. For example, the gray scale conversion circuit 240 is connected to the data input circuit 210, and is configured to, upon receiving display data belonging to other data partitions except for the at least one of the data partitions, convert the display data belonging to the other data partitions into display data in the at least one data partition according to a proportional relationship between output durations corresponding to the other data partitions and an output duration corresponding to the at least one of the data partitions, so as to obtain driving currents corresponding to the display data belonging to the other data partitions according to the corresponding relationship between display data and driving current of the at least one data partition.

For example, as shown in FIG. 3A, it is assumed that the display panel stores the corresponding relationship between display data and driving current in data partitions (e.g., the second data partition) with a gray scale demarcation point X of a gray scale value. Therefore, in the case where the data input circuit 210 receives the display data in these data partitions (e.g., the second data partition), the display data in these data partitions can be directly sent to the time selection circuit 220, so that the output durations corresponding to the display data are determined according to the display data. However, in the case where the data input circuit 210 receives the display data in a data partition (for example, a data partition with a gray scale value smaller than the gray scale demarcation point X (for example, the first data partition)) in which the corresponding relationship between display data and driving current is not stored in the display panel, these display data may be transmitted to the gray scale conversion circuit 240 first. The gray scale conversion circuit 240 can convert display data belonging to the first data partition into display data belonging to the second data partition according to the proportional relationship between the output duration corresponding to the second data partition and the output duration corresponding to the first data partition, that is, the proportional relationship between t2 and t1, so that the driving current belonging to the display data in the first data partition can be obtained from the corresponding relationship between display data and driving current in the second data partition stored in the display panel.

The specific implementation of each step can refer to the relevant descriptions in the pixel driving chip provided in the above embodiments of the present disclosure, and they will not be described in detail here. It should be noted that in various embodiments of the present disclosure, the flow of the driving method may include more or less operations, which may be executed sequentially or in parallel. The driving method described above may be executed once or multiple times according to predetermined conditions. With regard to the technical effects of the driving method provided in the above embodiments, reference can be made to the technical effects of the pixel driving chip provided in the embodiments of the present disclosure, which will not be described in detail here.

The specific implementation of the above steps can refer to the relevant descriptions in the pixel driving chip provided in the above embodiments of the present disclosure, and they are not described in detail here.

It should be noted that in a plurality of embodiments of the present disclosure, the flow of the driving method may include more or less operations, which may be executed sequentially or in parallel. The driving method described above may be executed once or a plurality times according to predetermined conditions.

With regard to the technical effects of the driving method provided in the above embodiments, reference can be made to the technical effects of the pixel driving chip provided in the embodiments of the present disclosure, thus the technical effects of the driving method are not described in detail here.

The following points need to be explained:

(1) the drawings of the embodiments of the present disclosure only refer to the structures related to the embodiments of the present disclosure, and other structures can refer to the general design.

(2) under the condition of no conflict, embodiments of the present disclosure and features in embodiments can be combined with each other to obtain new embodiments.

What have been described above are only specific implementations of the present disclosure, the protection scope of the present disclosure is not limited thereto. The protection scope of the present disclosure should be based on the protection scope of the claims.

What is claimed is:

1. A pixel driving chip, comprising: a data input circuit, a time selection circuit, and a current control circuit, wherein the data input circuit is connected to the time selection circuit, and is configured to receive display data and partition the display data according to a gray scale demarcation point to obtain a data partition, to which the display data belongs, among M data partitions obtained based on a range of the display data, and the M data partitions respectively correspond to M output durations;

the time selection circuit is connected to the data input circuit and the current control circuit, and is configured to determine an output duration corresponding to the display data according to the data partition to which the display data belongs, and output the display data to the current control circuit within the output duration; and the current control circuit is connected to the time selection circuit, and is configured to determine a driving current flowing through a light-emitting element, corresponding to the display data, according to the display data and output the driving current based on the output duration corresponding to the display data, where M is an integer greater than 1.

2. The pixel driving chip according to claim 1, wherein the driving current flowing through the light-emitting element, the output duration and brightness corresponding to the display data satisfy a following formula:

$$B=\int K*I*T,$$

where B represents the brightness corresponding to the display data, I represents the driving current flowing through the light-emitting element, T represents the output duration, and K represents a scale factor.

3. The pixel driving chip according to claim 2, wherein minimum display data of an (m+1)-th data partition is greater than maximum display data of an (m)-th data partition, and an (m+1)-th output duration corresponding to the (m+1)-th data partition is greater than an (m)-th output duration corresponding to the (m)-th data partition, where m is an integer greater than or equal to 1 and less than M.

4. The pixel driving chip according to claim 3, wherein output durations respectively corresponding to respective data partitions are obtained by rendering driving currents respectively corresponding to maximum display data in the respective data partitions to be same.

5. The pixel driving chip according to claim 4, wherein the pixel driving chip is configured to obtain a corresponding relationship of display data and a driving current of at least one of the data partitions; and the pixel driving chip further comprises a gray scale conversion circuit, wherein the gray scale conversion circuit is connected to the data input circuit, and is configured to, upon receiving display data belonging to other data partitions except for the at least one of the data partitions, convert the display data belonging to the other data partitions into display data in the at least one data partition according to a proportional relationship between output durations corresponding to the other data partitions and an output duration corresponding to the at least one of the data partitions, so as to obtain driving currents corresponding to the display data belonging to the other data partitions according to the corresponding relationship between the display data and the driving current of the at least one data partition.

6. The pixel driving chip according to claim 1, wherein the pixel driving chip is configured to obtain a corresponding relationship of display data and a driving current of at least one of the data partitions; and the pixel driving chip further comprises a gray scale conversion circuit, wherein the gray scale conversion circuit is connected to the data input circuit, and is configured to, upon receiving display data belonging to other data partitions except for the at least one of the data partitions, convert the display data belonging to the other data partitions into display data in the at least one data partition according to a proportional relationship between output durations corresponding to the other data partitions and an output duration corresponding to the at least one of the data partitions, so as to obtain driving currents corresponding to the display data belonging to the other data partitions according to the corresponding relationship between the display data and the driving current of the at least one data partition.

7. The pixel driving chip according to claim 6, further comprising a gray scale holding circuit, wherein the gray scale holding circuit is connected to the gray scale conversion circuit and the time selection circuit, and is configured to hold the display data belonging to the other data partitions in the display data that is converted, and output the display data that is converted to the time selection circuit when an output duration corresponding to the display data that is converted comes.

8. The pixel driving chip according to claim 7, wherein the time selection circuit comprises M time selection sub-circuits, and the current control circuit comprises M current control sub-circuits, wherein the M time selection sub-circuits are in one-to-one correspondence with the M data partitions, the M time selection sub-circuits are connected to the data input circuit and are in one-to-one correspondence with and connected to the M current control sub-circuits, and the M time selection sub-circuits are configured to select a time selection sub-circuit and a current control sub-circuit that are corresponding to the data partition to which the display data received by the data input circuit belongs, so that the time selection sub-circuit, which is selected, outputs the display data to a current control sub-circuit connected to the selected time selection sub-circuit within the output duration corresponding to the display data, and the current control sub-circuit outputs the driving current within the output duration corresponding to the display data.

9. The pixel driving chip according to claim 1, wherein the time selection circuit comprises M time selection sub-circuits, and the current control circuit comprises M current control sub-circuits, wherein the M time selection sub-circuits are in one-to-one correspondence with the M data partitions, the M time selection sub-circuits are connected to the data input circuit and are in one-to-one correspondence with and connected to the M current control sub-circuits, and the M time selection sub-circuits are configured to select a time selection sub-circuit and a current control sub-circuit that are corresponding to the data partition to which the display data received by the data input circuit belongs, so that the time selection sub-circuit, which is selected, outputs the display data to a current control sub-circuit connected to the selected time selection sub-circuit within the output duration corresponding to the display data, and the current control sub-circuit outputs the driving current within the output duration corresponding to the display data.

10. The pixel driving chip according to claim 9, further comprising a voltage conversion circuit, wherein the voltage conversion circuit is connected to a power supply, the data input circuit and the current control circuit, and is configured to convert a power supply voltage provided by the power supply into a voltage required by the data input circuit and the current control circuit.

11. The pixel driving chip according to claim 1, further comprising a voltage conversion circuit, wherein the voltage conversion circuit is connected to a power supply, the data input circuit and the current control circuit, and is configured to convert a power supply voltage provided by the power supply into a voltage required by the data input circuit and the current control circuit.

12. The pixel driving chip according to claim 11, further comprising a timing control circuit, wherein the timing control circuit is connected to the power supply, the time selection circuit and the current control circuit, and is configured to provide a clock signal for controlling the output duration corresponding to the display data.

13. The pixel driving chip according to claim 12, wherein the time selection circuit is configured to output the display data to the current control circuit within the output duration in response to the clock signal.

14. The pixel driving chip according to claim 11, further comprising at least one electrostatic discharge circuit, wherein the at least one electrostatic discharge circuit is respectively connected to at least one selected from a group consisting of the power supply, the data input circuit, the current control circuit and a ground terminal, and is configured to discharge static electricity generated by the at least one selected from the group consisting of the power supply, the data input circuit, the current control circuit and the ground terminal in a case where the at least one selected from the group consisting of the power supply, the data input circuit receives signals or outputs signals.

15. A display device, comprising: the pixel driving chip according to claim 1 and the light-emitting element, wherein the pixel driving chip is electrically connected to the light-emitting element to output the driving current flowing through the light-emitting element.

16. The display device according to claim 15, further comprising a gate driving circuit and a data driving circuit, wherein the gate driving circuit is configured to provide a scanning signal to the pixel driving chip; and the data driving circuit is configured to provide the display data to the pixel driving chip.

17. The display device according to claim 16, further comprising a display panel and a backlight unit, wherein the backlight unit comprises a plurality of backlight partitions and is driven by a local dimming mode, and at least one of the plurality of backlight partitions comprises the pixel driving chip and the light-emitting element.

18. The display device according to claim 15, further comprising a display panel and a backlight unit, wherein the backlight unit comprises a plurality of backlight partitions and is driven by a local dimming mode, and at least one of the plurality of backlight partitions comprises the pixel driving chip and the light-emitting element.

19. A driving method of the pixel driving chip according to claim 1, comprising:

receiving the display data by the data input circuit, and partitioning the display data according to the gray scale demarcation point, to obtain the data partition, to which the display data belongs, among the M data partitions obtained based on the range of the display data, wherein the M data partitions respectively correspond to the M output durations;

determining, by the time selection circuit, the output duration corresponding to the display data according to the data partition to which the display data belongs, and outputting the display data to the current control circuit within the output duration; and determining, by the current control circuit, the driving current flowing through the light-emitting element, corresponding to the display data, according to the display data, and outputting the driving current based on the output duration corresponding to the display data.

* * * * *